US005332115A

United States Patent [19]

Schäfer

[11] Patent Number: 5,332,115

[45] Date of Patent: Jul. 26, 1994

[54] BOX-SHAPED CONTAINER MADE FROM A PLASTIC MATERIAL

[75] Inventor: Gerhard Schäfer, Salchendorf, Fed. Rep. of Germany

[73] Assignee: Fritz Schafer Gesellschaft mit beschrankter Haftung, Neunkirchen, Fed. Rep. of Germany

[21] Appl. No.: 135,942

[22] Filed: Oct. 12, 1993

Related U.S. Application Data

[63] Continuation of Ser. No. 887,334, May 22, 1992, abandoned.

[30] Foreign Application Priority Data

Oct. 9, 1991 [DE] Fed. Rep. of Germany ..... 9112561

[51] Int. Cl.[5] ..... B65D 1/38

[52] U.S. Cl. ..... 220/608; 220/636; 220/DIG. 15

[58] Field of Search ..... 220/275, 639, 645, 648, 220/729, 608, 623, 636, DIG. 15, 668; 206/599, 386

[56] References Cited

U.S. PATENT DOCUMENTS

| | | | |
|---|---|---|---|
| Re. 32,344 | 2/1987 | Wind | 206/599 |
| 400,566 | 4/1889 | Harry | 220/636 |
| 1,139,534 | 5/1915 | Klenk | 220/636 |
| 1,839,210 | 1/1932 | Felts et al. | 220/636 |
| 1,877,551 | 9/1932 | Bruce | 220/668 |
| 2,475,513 | 7/1949 | Peckinpaugh | 220/636 |
| 2,828,007 | 3/1958 | Foss | 206/599 |
| 3,428,204 | 2/1969 | Wilson | 220/668 |
| 4,795,047 | 1/1989 | Dunwoodie | 220/668 |
| 4,872,574 | 10/1989 | Lam | 220/668 |
| 4,947,988 | 8/1990 | Schutz | 220/668 |

FOREIGN PATENT DOCUMENTS

| | | | |
|---|---|---|---|
| 386313 | 9/1990 | European Pat. Off. | 220/DIG. 15 |
| 2165203 | 7/1973 | Fed. Rep. of Germany | 220/668 |
| 8137907 | 5/1982 | Fed. Rep. of Germany . | |
| 8903430 | 8/1989 | Fed. Rep. of Germany . | |
| 6511417 | 3/1966 | Netherlands | 220/DIG. 15 |
| 2255968 | 11/1992 | United Kingdom | 220/DIG. 15 |

*Primary Examiner*—Stephen Castellano
*Attorney, Agent, or Firm*—Anderson Kill Olick & Oshinsky

[57] ABSTRACT

A box-shaped container is described which comprises flat straps spaced beneath the base of the container. These flat straps extend along the base edge and are abutted against the base by stiffening ribs. The base structure contains pocket-like free spaces formed by the base bottom side, the flat strap top side and the stiffening ribs oriented transversely thereto, which free-spaces are open on the sides of the base edge. A bend-through of the container base is to be securely countered by simple means if high weighted commodities are loaded into the container. Stiffening ribs comprise passages in the region of the individual pocket-like free spaces, which are followed by channels which open towards the bottom. Neck-like molded knobs are provided in the channels at the bottom side of the container base. Stiffening sections can be slid into the channels and fastened to the knobs.

3 Claims, 2 Drawing Sheets

BOX-SHAPED CONTAINER MADE FROM A PLASTIC MATERIAL

This is a continuation of application Ser. No. 07/887,334, filed May 22, 1992, abandoned.

FIELD OF THE INVENTION

The present invention deals with a box-shaped container which is manufactured and/or constructed from a plastic material and which may be used, among other things, as a storage and/or transport box. The bottom or base structure of the container of the present invention has a top side which is planar and a bottom side which is reinforced by stiffening ribs. Flat straps are utilized, which extend in the direction of the bottom plane and along the bottom edge. These flat straps may extend across the entire periphery of the box or may only extend in segments along the longitudinal and/or lateral sides of same. These flat straps are supported by stiffening ribs which are connected with the base edges and are oriented transversely to, and spaced beneath, the base edge. In this manner, a base for a container is formed which contains free spaces which are bounded between the lower side of the base, the upper side of the flat straps and the laterally oriented stiffening ribs. These free spaces are further designed to be opened outwardly or inwardly. Stiffening ribs which are located ahead, either inwardly or outwardly, of these free spaces, result in the formation of these free spaces.

BACKGROUND OF THE INVENTION

Box-shaped containers of this type, which may be made from plastic material and from an injection molded process, are already known in the prior art. Examples of these are German Patent DE-U 81 37 907, German Patent DE-U 89 03 430 and EP-A-O 86 313. The containers disclosed in the prior art, however, do not disclose containers which have the advantage of having their entire interior base surface, which provides planar support for commodities to be stored therein, while at the same time providing for a perfect support contact face for the box-shaped container, created by planar straps located beneath the base or bottom of the box. These planar straps, which are taught by the present invention, assure a high degree of stability for the container independently of whether the container is loaded or unloaded.

Box-shaped containers of the type disclosed by the present invention have inwardly oriented boundary edges for the flat straps, which form a base area, and which are spaced from the bottom base stiffening ribs, extending spaced therefrom and parallel to them, creating passages which open towards the bottom in the pocket-like bounded free spaces. This results in the advantage that the pocket-like free spaces, located between the lower side of the base, the upper side of the flat straps and the laterally oriented stiffening ribs, can be shaped with the use of conventional plastic injection molding tools. Further, the openings or passages provided at the ends of the free spaces, which face away from each other, enable a nearly unobstructed passageway for cleaning liquids so that these free spaces and the base structure adjacent thereto can be washed out and, therefore, undesirable residues removed from the base structure of the container. The base structure adjacent these free spaces can be cleaned, for instance, with liquids dispensed from cleaning jets. This is an important and beneficial feature especially if the box-shaped container is utilized in an industry where a hygienically clean state must be maintained.

The disadvantages associated with the plastic-made, box-shaped containers of the prior art also lies in the fact that their utilization has usually been limited to those instances where an excessive bend-through of the base, caused by the weight load of stored commodities, could only be eliminated by utilizing stiffening ribs on the bottom side of the base. The present invention provides for an improvement over the prior art containers in that the box container of the present invention enjoys the structural integrity of having stiffening ribs located integral with its base structure while, at the same time, provides a container which can be fabricated by molding plastic materials using injection molding techniques.

SUMMARY OF THE INVENTION

The object of the present invention is to provide an improved box-shaped container which is manufactured from plastic material so that a bend-through of the base is safely countered with a simple means. In this manner, an increased weight carrying capacity can be attained in these containers. Further, the improved box-shaped container provides the benefits associated with the fact that the container can be fabricated by injection molding techniques using plastic materials.

The present invention provides an improvement over containers of the prior art in that, not only are the stiffening ribs located upstream, inwardly and/or outwardly, from the openings or free spaces formed within the base structure of the container, but also, additional stiffening ribs, which run parallel thereto, provide for the formation of passages in the regions of the individual pocket-like bounded free spaces. These passages are respectively followed by channels which open downwardly and away from the base or bottom of the container and are bounded by two stiffening ribs. Neck-like molded knobs are located at the bottom side of the base and are distributed in the direction of these channels. Further, U-shaped or C-shaped stiffening sections can be slid into the pocket-like free spaces as well as into the channels, adjacent thereto, and can then be fixed thereto by means of blocking bolts, screws, ribbed nails or similar objects, which serve to engage into the knobs and pass through the stiffening sections in a lateral direction.

The increased stabilization of the container base brought about by the insertion of the stiffening sections can be performed at any time and with relatively little effort. Therefore, the stiffening sections can be installed and also removed as dictated by the stability requirements. Further, the stiffening sections, once secured within the bottom or base of the container, will be secured with little possibility that they could fall out accidentally.

The present invention also has utility for box-shaped containers of large dimensions, wherein channels extend exclusively in lateral directions from the base of the container and herein are also arranged symmetrically about the lateral center of the base of the container. One or several stiffening sections can be installed as required on the bottom side of the base depending upon the length of the box-shaped container. With smaller box-shaped containers the channels may also extend exclusively in the longitudinal direction of the base of the container and may be arranged symmetrically about the longitudinal center of the base of the container. In this manner, it is sufficient to utilize one single stiffening section and to install this section so that it lies along the longitudinal center of the container base. Box-shaped containers of the present invention may also utilize channels and stiffening sections both extending in the longitudinal and lateral directions along the bottom or base of the container.

Further, it has proved to be advantageous in the present invention if the profile height of the stiffening sections corresponds to a fraction of the maximum internal height measurement of the channels. The stiffening sections which are employed can be produced from rolled, edged, or also drawn metal sections. Longitudinal apertures of the metallic sections can herein be facing the base of the container and can be clamped against same by means of knobs for engagement of the fastening screws.

The various features of novelty which characterize the present invention are pointed out with particularity in the claims appended to and forming a part of this disclosure. For a better understanding of the invention, its advantages and specific objects attained by its use, reference should be made to the drawings and descriptive matter in which there is illustrated and described a preferred embodiment of the invention,

DETAILED DESCRIPTION OF THE PREFERRED EMBODIMENT

Figure 1:
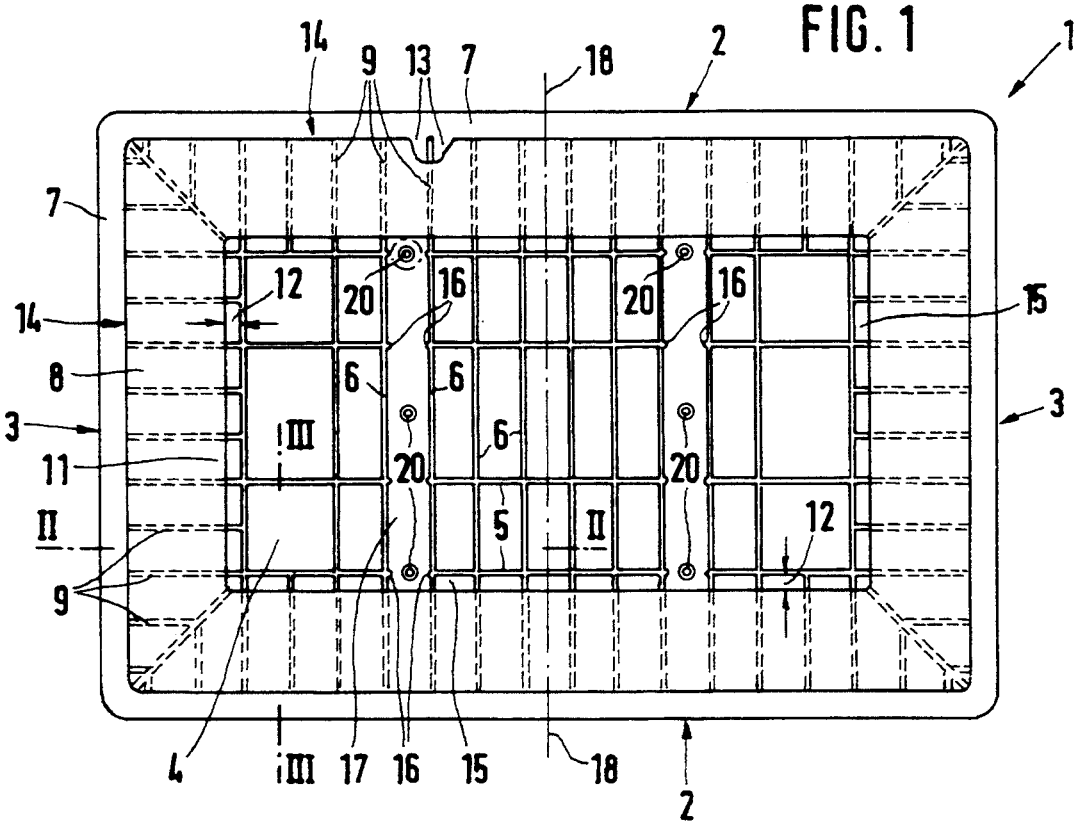
FIG. 1 illustrates the base or bottom of a box-shaped container viewed from below.

FIG. 1 illustrates the container 1 and, in particular, the bottom or base section 4 of said container which is the subject of the present invention. The improvement of the present invention essentially deals only with the base or bottom section 4 of the box-shaped container 1 as such improvement provides for a container, which is fabricated as an injection molded part from a plastic material. Since only the bottom or base 4 of container 1 is of interest to the present description, the makeup, design and/or composition of the longitudinal side walls 2 and lateral sidewalls 3 of the container are not important in the present description. As a result, only the specific design features of the base or bottom 4, along with the elements and structures relating thereto, will be the subject of the present description of the preferred embodiment.

As illustrated in FIG. 1, the base or bottom 4 of the box-shaped container 1 has longitudinal side walls 2 and lateral side walls 3 which extend from the base section 4 upwards to the top of the container. The present invention may be utilized in many different applications which include, but are not limited to, storing or containing goods or merchandise on tables, on pallets, or in similar storage and/or transportation containers.

An important advantage inherent in the present invention is that its unique design, as described herein, facilitates the ease of its manufacture so that they can be formed using plastic materials which are formed by injection molding techniques. It can be seen in FIGS. 2, 3, and 5 to 7 that the base 4 of the box-shaped container 1 has a top side which is planar overall. The bottom side of the base, however, is stabilized by longitudinally extending stiffening ribs 5 and laterally extending stiffening ribs 6, which are fabricated in one and the same process and workpiece as the base or bottom 4.

Figure 2:
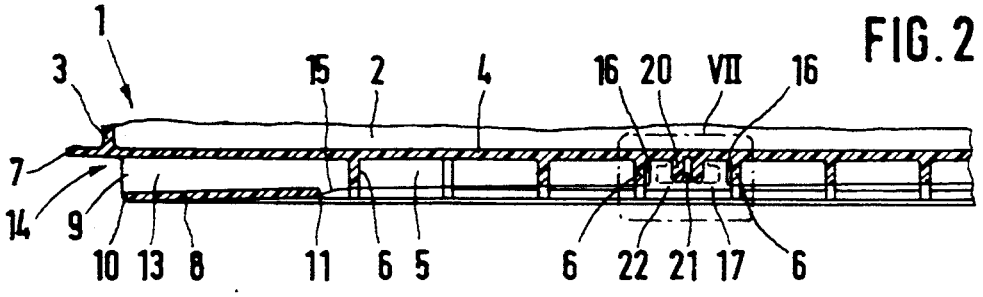
FIG. 2 illustrates a magnified cross section of the base of the container of FIG. 1 taken along the line II—II.
Figure 3:
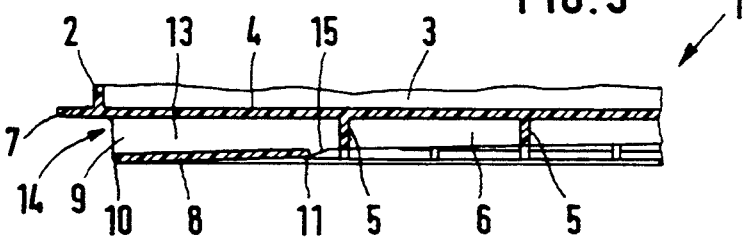
FIG. 3 illustrates a magnified cross section of the base of the container of FIG. 1 taken along the line III—III.
Figure 4:
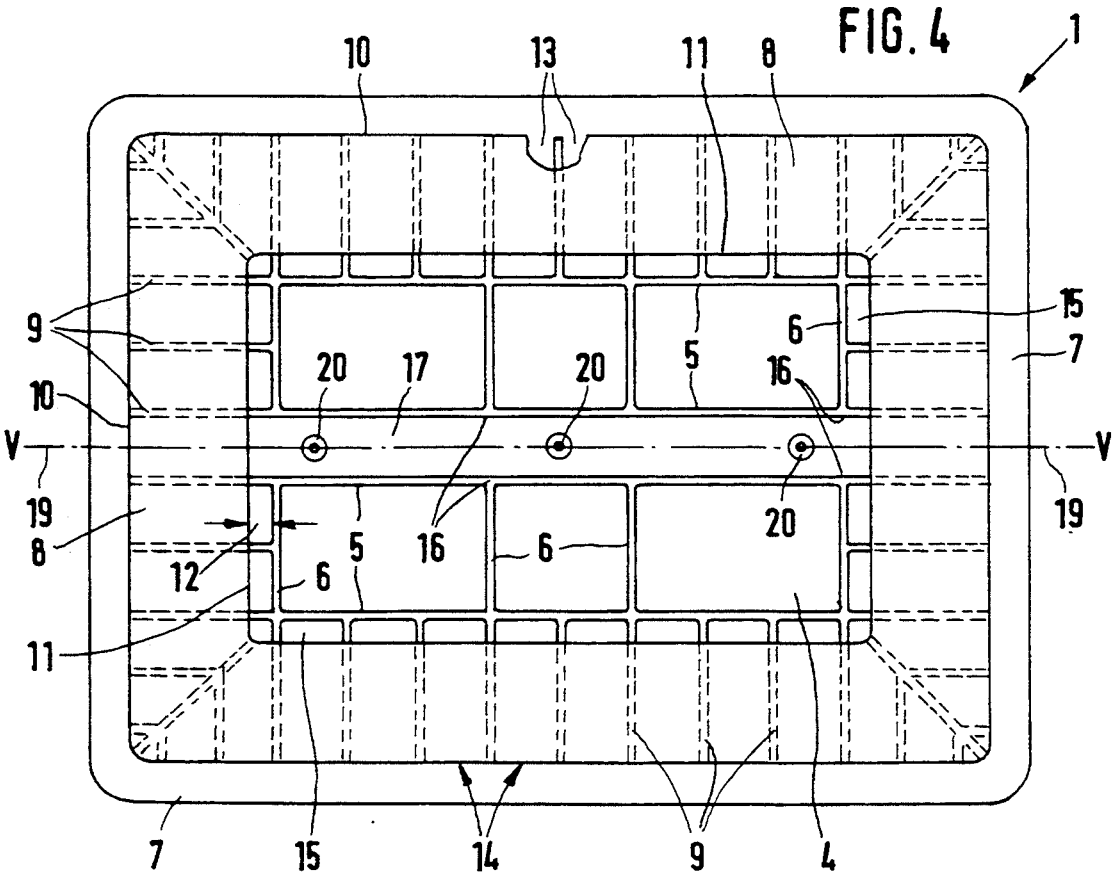
FIG. 4 illustrates an alternate embodiment of the base or bottom of a box-shaped container viewed from below.
Figure 5:
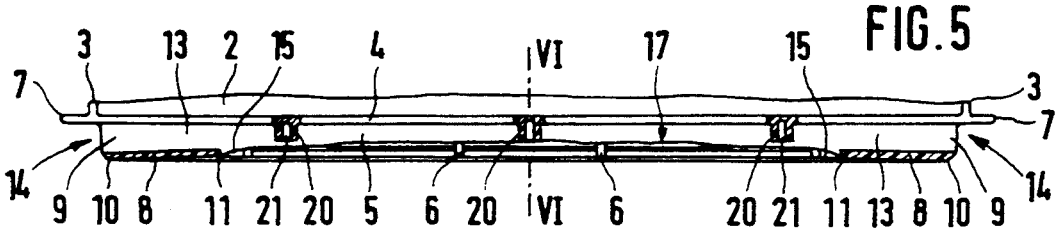
FIG. 5 illustrates a magnified cross section of the base or bottom of the box-shaped container of FIG. 4 taken along the line V-V.

As illustrated in FIGS. 2 and 4, base edge 7, projects in a flange-like manner past the outer boundary faces of the longitudinal walls 2 and the lateral walls 3. Flat straps 8 run in a horizontal direction parallel to the base 4 of the box, and are supported respectively by vertical stiffening ribs 9 which run laterally to the base edge 7 and are spaced from one another beneath the base 4. The flat straps 8 and the stiffening ribs 9 are also molded in one process and workpiece as the bottom or base 4 in the injection molding process, and further, in such a way that the stiffening ribs 9 follow, respectively, at wide angles to the outer stiffening ribs 5, 6, which extend parallel to the longitudinal walls 2 and the lateral walls 3 of the box-shaped container 1.

The flat straps 8 form a frame according to FIGS. 1 and 4. This frame, formed by the flat straps 8, is provided in such a way that the outer boundary edges 10 of the flat straps 8 do not extend the full length and width of the base edge 7. As shown in FIGS. 2, 3, 5 and 6, these outer boundary edges 10 are offset inwardly from base edge 7 so as to be within the perimeter of the base edge 7.

The inner boundary edges 11 of the flat straps 8 are positioned in such a manner that they respectively observe a spacing 12 which exists and extends from the outer stiffening ribs 5, 6, provided at the bottom side of the container base 4, parallel to said edges of the flat straps 8. The flat straps 8, therefore, form a supporting base for the box-shaped container 1. Further, the flat strap 8 also defines together with the laterally oriented stiffening ribs 9 and the bottom side of the container base 4, a storage base which contains a plurality of pocket-like openings or free spaces 13 which lie next to each other beneath the base or bottom 4. These pocket-like free spaces 13 are provided along the longitudinal and lateral edges of base edge 7 as shown in FIGS. 1 and 4.

Each pocket-like free space 13 has an aperture 14 on the side of the base edge 7. These free spaces comprise, at their inner end, a passage which opens towards the bottom, which exists respectively through the distance 12 between the inner boundary edge 11 and the adjacent stiffening rib 5, 6 of the base 4. The design of the pocket-like free spaces 13, which are open at both ends, facilitates the cleaning of said free-spaces, along with the base structure adjacent thereto, such as by flushing them out with cleaning agents such as cleaning fluids or cleaning liquids so as to remove residues accumulated therein or thereon.

FIGS. 2, 3, 5 and 6 illustrate that the stiffening ribs 5, 6, of the container base 4, which extend parallel to the inner boundary edge 11 of the flat straps 8, have a profile height with respect to the base bottom side, which is less than the inside spacing distance of the flat straps 8 from the bottom side of the container base or bottom 4. Such a design provides for a more desirable base structure wherein the pocket-like free spaces 13, along with the base structure adjacent thereto, can be flushed or cleaned with a cleaning liquid. In these instances, cleaning fluids can be flushed through the free spaces and exit through the passages 15 which are shown in FIGS. 1 and 4.

FIGS. 2, 3, 5 and 6 further illustrate that the flat straps 8 are situated in an inclined position. The flat straps have an incline which rises from their outer boundary edge 10 towards their inner boundary edge 11. The angle of inclination can typically be between 1° and 2° with 1.5° being preferred. The employment of inclined flat straps 8 assists in assuring a perfectly planar base even in those instances where heavy weighted commodities are stored in the box-shaped container 1. The use of inclined flat straps is beneficial in that the bottom or base 4 of the container 1 can bend through said incline to such an extent that, if the container is placed upon a planar base, the flat straps 8 will achieve a horizontal position by bending, if necessary, in order to support the weighted contents of the container. In this manner, the present invention ensures that the contents of a container will be stored properly and in a stabilized manner. A small spacing between the stiffening ribs 9 provides sufficient support for the flat straps 8 in that they are prevented from bending in an undesirable manner laterally to their plane.

Further, in order to facilitate the transportation of the container of the present invention over consecutive rollers of a rolling conveyor (not shown), it has been determined that the spaces between the stiffening ribs 9, which are laterally oriented to the bottom base edge 7, should be smaller than the usual spacing between the rollers of the transport means.

In this manner, a smooth travel of the box-shaped container 1 over the transport means is assured. It can be seen from FIGS. 1 and 4 that the width of the flat straps 8 are preferably to be dimensioned so that they are larger than the distance between the stiffening ribs 9. It has been determined to be advantageous if the width of the flat straps 8 are at least twice as large as the distance between two neighboring stiffening ribs 9.

It can be seen in FIGS. 1 and 4 that the stiffening ribs 5, 6 have a grate-like arrangement in the central region of the container base. It can also be seen in FIGS. 2, 3, 5 and 6 that the stiffening ribs 5, 6 can also have profile heights which diminish in the direction towards the center of the container base 4.

It is important that the stiffening ribs 5, 6, which extend parallel to the inner boundary edges 11, of the flat straps 8, and which form the base area, contain passages 16 in the region of individual pocket-like bounded free spaces 13. Channels 17, which open downwards and away from the base 4, follow upon these passages 16. Each passage 16 is bounded by two stiffening ribs 5, 6 which extend laterally to the inner boundary edges 11 of the flat straps 8.

In FIG. 1, the channels 17 which are shown to be located in the area of the passages 16 and which follow therefrom, extend respectively, in the direction of the width of the box-shaped container, laterally to the stiffening ribs 5 and parallel to the stiffening ribs 6.

FIG. 4 illustrates an alternate embodiment of the present invention wherein the channels 17 are bounded by passages 16 which extend in a direction longitudinal of the box-shaped container 1, parallel to the stiffening ribs 5, and laterally or transversely to the stiffening ribs 6. Regardless of the embodiment chosen, it is advisable to arrange the passage 16 and the corresponding channel 17 arrangement so that they are symmetrical about a central plane of the box-shaped container 1. Therefore, in the embodiment illustrated in FIG. 1, the channel 17 will lie on both sides and parallel to the transverse or lateral central plane 18, 18. In the embodiment illustrated in FIG. 4, the channel 17 will lie on the longitudinal central plane 19, 19. It is also envisioned that additional channels 17 may be provided directly on the lateral central plane 18 of the box-shaped container 1 as is illustrated in FIG. 1. In the same manner, it is also possible to provide additional channels 17 which can be located symmetrically about both sides of the longitudinal plane 19, 19 of the container of FIG. 4.

It can be readily sen from FIGS. 1 and 4 that knobs 20, which are molded in a neck-like fashion and situated on the bottom side of the container base 4, are distributed longitudinally in the direction of the channel 17. Each knob 20 contains a cavity 21 which will facilitate the containment of a screw as is clearly illustrated in FIGS. 4, 5, 6 and 7.

Stiffening sections 22 having, for instance, a U-shaped or C-shaped cross section, can be slid from the peripheral side of the base 4, into the channels 17, and into the free spaces 13 adjacent the respective channel 17. The end regions of the stiffening sections 22 are received into the free spaces 13 which are respectively assigned in a direction parallel to each of the longitudinal walls 2 or lateral walls 3 of the box-shaped container 1, while their remaining longitudinal region in the respective channel 17, located in the inner boundary edges 11 of the flat straps 8, are exposed towards the bottom of the base.

Figure 6:
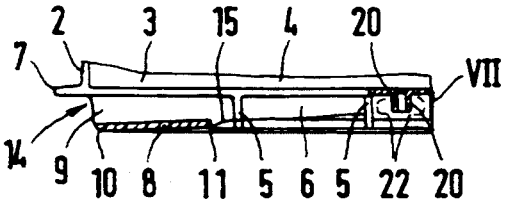
FIG. 6 illustrates a magnified cross section of the bottom or base of the box-shaped container of FIG. 5 taken along the line VI-VI.
Figure 7:
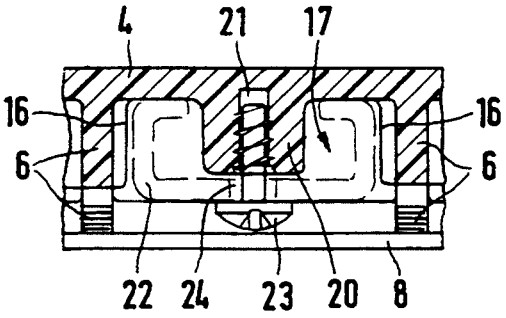
FIG. 7 illustrates a magnified area cutout from FIGS. 2 and 6 designated by the reference numeral VII.

FIGS. 2, 6 and 7 illustrate these stiffening sections 22, which can be U-shaped or C-shaped in cross section, facing the container base 4. It can be noted that the open longitudinal side of the stiffening sections 22 comes to rest against the underside of the base 4 so as to provide support for the base 4. In FIG. 7, the stiffening section 22 lies directly in front of the end face of the neck-like knobs 20 and can be clamped against same by means of a screw 23 which is threaded into the threaded cavity 21. A screw 23, which passes through the hole 24 and into the base 4, not only secures the stiffening section 22 against its longitudinal displacement within the channel 17, but also provides it with a prestress in a direction against the container base 4. In this manner, added support for the base 4 can be provided by these prestressed stiffening sections 22.

If, however, it is not desired to apply a prestress to the stiffening sections 22, then ribbed pins or ribbed nails can be utilized to secure the stiffening sections 22 to the base 4 while guarding against their displacement. Such a method for securing the stiffening sections would be sufficient because the end regions of the stiffening sections 22 are supported in the pocket-like free spaces 13 within the base structure and upon the flat straps 8 so as to prevent their being lowered.

It can also be seen from FIGS. 2, 6 and 7 that the profile heights of the stiffening sections 22 correspond to only a fraction of the maximum internal height measurements for the channels 17 so that there will be provided a certain distance above the base 4 with said distance defined by the flat straps 8.

It is also possible, as an alternative to the employment of the channels 17 of FIGS. 1 and 4, to utilize stiffening sections 22, which have small structural heights, as a means by which to provide support for the base 4. This can be accomplished by merely providing stiffening ribs 5, 6 with passages 16 which permit the stiffening sections 22 to slide therein in their longitudinal direction. The stiffening sections may then be attached to the base by attachment means described herein.

The stiffening sections 22 utilized in the present invention may be produced from rolled, edged, or drawn metal sections. Further, these stiffening sections 22 can be provided with a surface coating for protecting them against corrosion.

It is also possible to obtain a box-shaped container 1 of the present invention in such a manner that the base 4 has a design which can be obtained by combining the designs of FIGS. 1 and 4. Also, depending upon the requirements for a given application, stiffening sections 22 can be inserted into channels 17 which run parallel to the lateral central plane 18, 18, in FIG. 1 or parallel to the longitudinal central plane 19, 19 in FIG. 4. The utilization of stiffening sections 22, however, may also be optional.

Another important design feature of the present invention lies in the fact that the flat straps 8, which extend in a direction horizontal to the base 4 of the container 1 may have an inclined orientation so that they exhibit a slight incline in rising from their outer boundary edge 10 to their inner boundary edge 11. The inner boundary edge 11 may further serve as a contact support for the bottom sides of the stiffening sections 22.

Since the inner boundary edge 11 can only be bent through a limited field of movement, with said field of movement dictated by the amount of incline designed into the flat straps 8, once the flat straps 8 have achieved a horizontal position, the flat straps 8 are capable, by means of their inner boundary edge 11, of providing an important structural support region for attachment of the stiffening sections 22.

The present invention, as described herein can be modified in various ways without deviating from the basic construction and fabrication principles described herein. For instance, it would easily be possible to run the inner boundary edges 11 of the flat straps 8 up to the first adjacent stiffening rib 5, 6 so that the spacing 12 thereinbetween would be eliminated completely. In this manner, a single piece of material would result which would be uniform in its connection of the flat straps 8 with the stiffening rib 5, 6.

It would also be possible to select the distance of the spacing 12, between the inner boundary edge 11 of the flat straps 8 up to the first adjacent stiffening rib 5, 6, so that the spacing would be larger than is shown in FIGS. 1 and 4. However, in this configuration, the stiffening ribs 5, 6 would be required to run between the flat straps 8 and along the bottom sides of the container base 4 so that they coincide with the outer boundary edges 10 of the flat straps 8.

In both of the above-mentioned alternate embodiments, the stiffening ribs 5, 6 would be adjoined to or connected with the inner boundary edge 11 or the outer boundary edge 10 of the flat straps 8 so as to form one continuous structure. The stiffening ribs 5, 6, in these embodiments, may then be provided with passages 16 at locations where channels 17 could be located for receiving stiffening sections 22. The channels 17 in these embodiments could also be bounded by two parallel extending stiffening ribs 5, 6.

While the present invention has been described herein in a preferred embodiment, such description is only illustrative of the present invention and is not meant to be a limitation thereof. Accordingly, the present invention encompasses any and all modifications and/or variations of the apparatus described herein with the scope of the present invention limited only by the claims which follow.

We claim:

1. A plastic container, comprising:

a base having a top side defining a planar commodity supporting surface, which is limited by two longitudinal walls and two transverse walls defining together an inner space of said container, a bottom side, and an edge portion, which is defined by a portion of said base projecting beyond said two longitudinal walls and said two transverse walls;

first and second stiffening ribs located on said bottom side and extending, respectively, parallel to said longitudinal walls and said transverse walls for stabilizing said base;

a plurality of flat straps, which extend along a perimeter of said edge portion inward thereof and substantially parallel to said base in a spaced relationship thereto and parallel to said longitudinal walls and said transverse walls, wherein said flat straps form a foot surface of said container;

a plurality of third stiffening ribs which extend along the perimeter of said edge portion inwardly thereof and transverse to said bottom side and parallel to said longitudinal walls and said transverse walls, for connecting said flat straps with said bottom side;

wherein respective portions of said bottom side of said base, said flat straps, outer ribs of said first and second stiffening ribs and said third stiffening ribs form a plurality of pocket-like free spaces each having opposite lateral sides, which are defined by outer and inner boundary edges of a respective flat strap, an opening formed between said bottom side and a respective boundary edge of the respective flat strap at one of said opposite lateral sides, and a downwardly open passage at another of said opposite lateral sides, which is formed by a clearance between another boundary edge of the respective flat strap and a respective outer rib.

2. The container of claim 1, wherein said opening is formed adjacent to said edge portion, and said downwardly open passage is formed between the inner boundary edge of the respective flat strap and the respective outer rib.

3. The container of claim 2, wherein parallel pairs of said first and second stiffening ribs have, in a region of respective pocket-like free spaces, passages extending horizontally parallel to one of said longitudinal walls and said transverse walls, respectively;

wherein in a region of said horizontally extending passages, respective downwardly open channels are formed between said pairs of said first and second stiffening ribs;

wherein said bottom-side of said base has a plurality of neck-like molded knobs arranged in a longitudinal direction of each downwardly open channel;

wherein a stiffening section encompassing a respective knob is arranged in each downwardly open channel; and wherein a lock element is provided for securing each stiffening section to each respective knob.

* * * * *